United States Patent [19]

Brede et al.

[11] Patent Number: 4,651,254

[45] Date of Patent: Mar. 17, 1987

[54] INDUCTIVE IGNITERS WITH SECONDARY COIL

[75] Inventors: Uwe Brede; Heinz Kern, both of Fürth; Gerhard Kordel, Nürnberg-Kornburg, all of Fed. Rep. of Germany

[73] Assignee: Dynamit Nobel Aktiengesellschaft, Fed. Rep. of Germany

[21] Appl. No.: 720,297

[22] Filed: Apr. 5, 1985

Related U.S. Application Data

[63] Continuation of Ser. No. 525,890, Aug. 24, 1983, abandoned.

[30] Foreign Application Priority Data

Aug. 24, 1982 [DE] Fed. Rep. of Germany ..... 3231369

[51] Int. Cl.[4] ..... F23Q 7/00; H01F 5/00

[52] U.S. Cl. ..... 361/248; 102/202.5; 102/472; 336/200; 336/DIG. 2

[58] Field of Search ..... 102/472, 202.5, 209, 102/200, 322; 361/248, 264, 265, 266; 219/270; 336/200, 232, 180, DIG. 2

[56] References Cited

U.S. PATENT DOCUMENTS

| | | | |
|---|---|---|---|
| 2,014,524 | 9/1935 | Franz | 336/200 |
| 2,911,605 | 11/1959 | Wales, Jr. | 336/200 |
| 3,002,260 | 10/1961 | Shortt et al. | 336/200 X |
| 3,484,731 | 12/1969 | Rich, III | 336/200 |
| 3,528,172 | 9/1970 | Smulkowski | 336/200 X |
| 3,812,442 | 5/1974 | Muckelroy | 336/200 X |
| 4,369,557 | 1/1983 | Vandebult | 336/200 X |

FOREIGN PATENT DOCUMENTS

| | | | |
|---|---|---|---|
| 1239773 | 5/1967 | Fed. Rep. of Germany | 336/200 |

*Primary Examiner*—Thomas J. Kozma

*Attorney, Agent, or Firm*—Antonelli, Terry & Wands

[57] ABSTRACT

A secondary coil is provided for use in inductive igniters for the igniting of propellant charge powder. In these igniters, two coil systems cooperate with each other in accordance with the transformer system, wherein the secondary coil is to be as small as possible and is to form a compact unit with the igniter. This is accomplished by arranging the windings of the secondary coil in the form of flat sandwich coils on a support material in an insulated fashion so that upon folding of the support material, the individual flat coils are placed in mutual opposition so that they form a cylinder coil. Furthermore, these flat coils are connected with each other by way of their outermost and innermost windings, the transition from the outermost windings being located at the crease and the innermost windings being joined together so that the flat coils are disposed almost in congruence on the front side as well as on the rear side, and the transition of the innermost coils being effected by a metallized path extending through the carrier material.

6 Claims, 5 Drawing Figures

INDUCTIVE IGNITERS WITH SECONDARY COIL

This is a continuation of application Ser. No. 525,890, filed Aug. 24, 1983, now abandoned.

This invention relates to igniters for the ignition of propellant charge powder, operating according to the induction principle. In particular, the invention concerns the secondary coils contained in these igniters, and the manufacture of such coils.

The principle of noncontactual energy transmission for ignition purposes has been known, for example, from DOS (German Unexamined Laid-Open Application) No. 2,734,169 and German Patent Application No. P 30 24 554.9. In these ignition systems, two coil systems cooperate in accordance with a transformer arrangement. The secondary coil, effecting actual ignition via a carrier element with ignition resistor and electric terminals, is to be as small as possible in these systems—i.e., the coils are to have a diameter of maximally 10 mm with a total height of about 0.5–1.5 mm. Such carrier elements with ignition resistor are disclosed, for example, in DOS No. 1,771,889 and German Pat. No. 2,020,016. When using wound wire coils with many individual structural components, as customary heretofore, the establishment of soldering points and contact points, as well as the entire connecting technique, could be achieved without any problems. However, these conventional procedures cannot be applied to the manufacture of coils having small dimensions, so that the desired miniaturization of the secondary coil poses grave problems in series production.

The object of this invention thus resides in constructing, in the zone of the secondary coil, a system uncomplicated from the viewpoint of manufacturing technique and consisting of only a few building blocks, which system is mechanically compact, has a few electrical connecting interfaces; i.e., connections, and withstands the pressure to be expended when filling with the ignition charge.

In attainment of this object, a secondary coil for an inductive igniter has now been developed which is in the form of a multilayer cylindrical coil and is fashioned with several windings in each layer; this secondary coil cooperates inductively with a primary coil according to the transformer principle and is electrically conductively connected to a support element with an ignition resistor. This coil is characterized in that the windings lying perpendicularly to the cylinder axis are provided in the form of separate, flat coils on a folded-over sheet-like support material, the creases thereof being, respectively, located between adjacently arranged flat coils, these coils being mutually insulated in the zone of their flat extension and selected flat coils being connected with each other only at a crease point and other flat coils being connected through the support material.

The support material is preferably a high-strength but flexible polyimide or a corresponding polyester. The various portions of the windings of flat coils are applied by a conventional technique to this support material. This is done, for example, by laminating to both sides of the support sheet a foil of a conductive metal; e.g., copper, and then etching a conductor pattern, by using a conventional etching procedure, on both sides in the form of flat coils. The conductor pattern in each case is arranged so that the outermost windings of two flat coils, located in side-by-side relationship in the completely installed or assembled cylinder coil, are connected to each other at a provided crease point of the support material. The term "the outermost winding" is understood herein to mean the winding with the, respectively, largest diameter. The term "the innermost winding"; i.e., the winding with the smallest diameter, passes, respectively, through the support material so that here, too, electrically conductive transition is ensured from one flat coil to the next flat coil on the other side of the support material. Preferably, the support material is provided at this inner transition point with cutouts of a corresponding diameter, metallized in a conventional manner to permit uninterrupted electrical contact.

This arrangement of the conductor pattern in the form of flat coils on the front and rear sides of sheet-like substrate material makes it possible to manufacture the coils of this invention in a planar fashion. The windings are applied to a sheet material, in their arrangement as set forth above, and are subsequently provided with an insulating cover coating or an insulating intermediate layer, or a similar insulation. Thereupon the sheet is folded at the intended places; i.e., at the crease points, and the individual folded sides are joined by pressing and/or gluing. Folding is preferably effected in a meander-like fashion (as shown in FIG. 2).

Folding takes place at the transition point from an external winding of a flat coil to the outermost winding of the subsequent flat coil, preferably in such a way that the windings on the subsequent folded side come to lie on the inside of the fold. With the same direction of rotation of two adjacent windings in the plane, the thus folded-together windings are then present in the coil in mutually opposed direction of rotation as right-hand and left-hand coil images. It is possible in this way to produce coils wherein the windings of the flat coils of two adjacent folded sides are, respectively, running counter to each other. This arrangement provides, advantageously, an increase in the induced voltage.

In a preferred embodiment, the two folded sides forming the end of the coil unit are not provided with a conductor pattern: one folded side, delimiting the folded-together cylinder coil toward the outside, is left partially or entirely covered with metal lamination. This side then is provided for mass contacting (i.e., ground contacting) with the igniter. The other outermost folded side is free completely of the coil-shaped metallic coating except for a small internal ring in the coil axis. This internal ring then serves as an electrical connection zone for the ignition resistor of the igniter.

The coils of this invention preferably exhibit a total number of 40 to 90 windings, distributed over preferably 4 to 8 support sides or portions of the support material which is folded and coated on both sides with the flat coils. Of course, the number of windings depends, inter alia, on the size of the primary coil (schematically shown in FIG. 5).

The support sheet preferably has the same geometrical shape and size as the flat metal coil applied thereto, which coil is made preferably of a spiral configuration, wherein the spiral can also be modified to an ellipsoid shape or an almost rectangular shape. In case of a spiral configuration, the diameter of the largest circle circumscribed around the coil of this invention is preferably between 5 and 10 mm. The height of the coil unit of this invention depends on the number of folded sides or portions and the thickness of the support sheet material; this height is preferably between 0.3 and 0.8 mm, but can also be considerably larger depending on how many folded sides with flat coils are to constitute the coil unit of this invention.

Another preferred embodiment resides in forming, in conjunction with the resistor of the igniter element, an oscillating (resonant) circuit wherein the circuit characteristic must be adapted to the field change of the transmission system to ensure optimum heat conversion in the resistor of the igniter element to activate the igniter charge. It is, furthermore, possible, for example, to arrange in the interior of the folded coil arrangement a contact, made up of a magnetic material, to the support element, adapted in its frequency characteristic to the resonant frequency of the oscillating circuit.

The coil of this invention and its mode of operation in a primer cap will be explained as an embodiment with reference to FIGS. 1 through 5 wherein:

FIG. 1 shows a plan view of each side of a support sheet material provided with the electrical connections and/or metallized coil pattern of copper or like conductive metal to form a coil unit;

FIG. 2 schematically shows the manner in which the support material and associated metallized pattern is folded in a meander-like manner;

Figure 1:
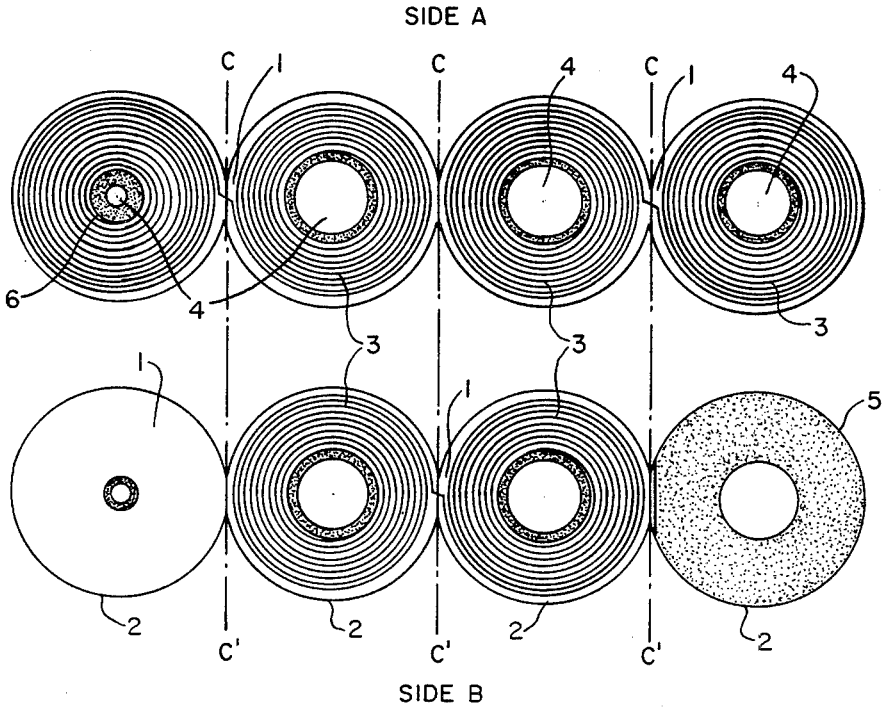

FIG. 1 shows an embodiment having 55 windings of, in total, 6 flat coils. The not yet folded coil arrangement is illustrated in one plane, wherein side A is the front side and side B is the rear side of an unfolded coil unit. The substrate support material 1 here comprises the four flat sides or portions, 2 on which are reproduced, respectively, the various flat coils 3 with their spiral-shaped windings. The openings 4 of the folding sides 2 serve for establishing contact between planar sides A and B. Furthermore illustrated are the connecting zone 5 for mass contacting and the connecting zone 6 for the ignition resistor, not shown. The lines C—C' indicate the crease point locations. The number of flat coils can be determined according to the task to be performed. An insulating covering in the form of a coating 30 is applied to selected sides and portions thereof as indicated in FIG. 3.

Figure 2:
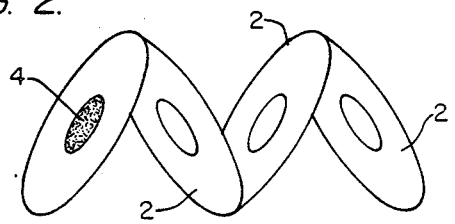

FIG. 2 shows an intermediate stage of the folded coil unit and illustrates the meander-like arrangement or shape of the sides 2.

Figure 3:
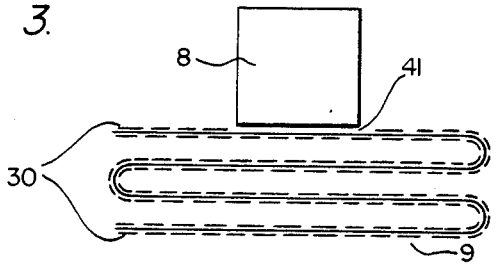
FIG. 3 shows a side view of the assembled coil unit or pack and associated support element.

FIG. 3 shows the arrangement of a supporting element 8 with respect to the assembled coil unit or pack 9 and an insulation covering in the form of a coating 30. The electrical supporting element, the ignition resistor of which is conventionally fashioned as a bridge or a gap, and which is in contact with the folded coil pack 9 or also is inserted in the opening 4 of the connecting zone with the aid of a pin, is in contact with connecting zone 6 (not shown) with the beginning of the coil, on the one hand, in the central part by way of a suitable electrical connection 41, for example the aforementioned pin, and is electrically connected with the coil end at 5 on the outer circumference 42, for example by way of an electrically conductive support member 10 and cap 11 (see also FIG. 4).

The folded and compressed coil unit 9, in conjunction with the supporting element 8, represents a compact structural element which can be highly stressed mechanically and withstands, for example, subsequent compressive pressures during loading of the ingniter charge 12 of about 20,000N/cm$^2$.

Figure 4:
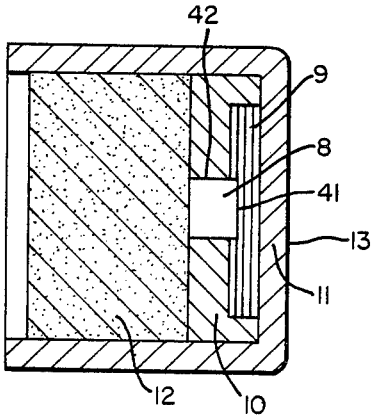
FIG. 4 shows a cross-sectional longitudinal view of the coil unit in the assembled inductive igniter.

FIG. 4 shows an overall view of the inductive igniter. The coil pack 9 with the electrical igniter element 8 is inserted in a supporting member 10 and forms a mechanically firm unit with the outer cap 11. After testing the electric features, if desired, the inductive igniter is charged with the igniter combustible charge 12.

The mechanical components 8–11 of the inductive igniter can consist of combustible as well as noncombustible materials. The supporting member 10 preferably consists of a soft iron or high-strength sintered material with ferromagnetic properties to improve magnetic flux and thereby to increase the induced voltage. The cap 11 is preferably made of antimagnetic (dia- or parmagnetic) materials. In this connection, brass or stainless steel is preferably utilized. In case of the combustible version, the supporting member 10 is made up of a composite material, consisting of glass fiber, octogen, a ferromagnetic metal powder or metal oxide powder, and resin as a binder; the surface must be electrically conductive for contacting purposes.

The outer cap 11 consists of a composite material made up of glass fiber-octogen and resin as the binder.

Figure 5:
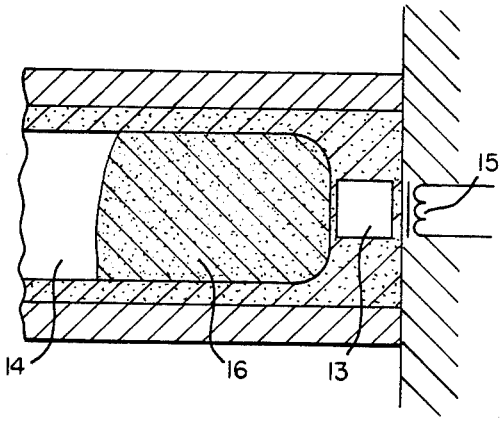
FIG. 5 shows the inductive igniter positioned adjacent to the propellant charge to be ignited.

In order to explain the operation of the secondary coil as an assembled unit, FIG. 5 shows the inductive igniter 13 in a chamber 14 filled with propellant charge powder 16. When the inductive igniter 13 is exposed to a magnetic alternating field applied by the primary coil 15, wherein the coil and the ignition resistor form an oscillating circuit, the optimum voltage is induced in the secondary coil in a manner known, per se, at the resonant frequency of the oscillating circuit; this voltage drives, through the electric resistor of the igniter element, an ignition current effecting a conversion into Joule's heat to ignite the ignition charge 12 in the igniter 13. The propellant charge powder 16 is thereby ignited. A complete conversion; i.e., combustion, of all combustible materials in the chamber 14 then occurs.

What is claimed is:

1. An inductive igniter, comprising a multilayer cylindrical secondary coil having several metal windings in each layer which cooperates inductively with a primary coil according to the transformer principle and which is electrically connected to a supporting element with an ignition resistor; said windings being arranged to lie perpendicularly to the longitudinal axis of the coil and being provided in the form of at least two separate, flat coils spaced along one side of a sheet-like substrate material and in the form of at least four separate, flat coils spaced along the other side of the substrate material; said substrate material being folded together and having creases located, respectively, between flat coils adjacently arranged on a side of said substrate material; and selected flat coils having outermost winding that are electrically connected with each other at a crease point, but being mutually insulated with respect to each other in the zone of a planar extension of each flat coil and other flat coils having innermost winding that are electrically connected through said substrate material; the folds of said sheet-like substrate material being so arranged that the outermost windings of the flat coils of two adjacent folded sides run respectively counter to each other whereby an increase in the induced voltage is achieved.

2. The inductive igniter according to claim 1, wherein each of said windings is produced by etching copper laminated on the substrate material.

3. The inductive igniter according to claim 1, wherein that one of the folded sides delimiting the outside of cylindrical coil which is in contact with an igniter wall for mass contacting or ground contacting, is at least partially covered by a metallized coating.

4. The inductive igniter according to claim 3, wherein an inner winding of the other external folded side is fashioned as a connecting zone for the ignition resistor of the supporting element.

5. The inductive igniter according to claim 1, wherein a plurality of windings are provided on each planar side of the support material to provide said separate flat coils spaced along each planar side of the support material, said flat coils having outermost windings near the periphery of each folded side of the support material and innermost windings near the center of each folded side.

6. The inductive igniter of claim 5, wherein the flat coils being connected with each other by way of their outermost and innermost windings, the transition from the outermost windings being located at the crease and the innermost windings being joined together so that the flat coils are disposed almost in congruence on the front side as well as on the rear side, and the transition of the innermost coils being effected by a metallized path extending through the carrier material.

* * * * *